United States Patent [19]

Reist

[11] 4,333,559

[45] Jun. 8, 1982

[54] APPARATUS FOR INFEEDING FLAT PRODUCTS, ESPECIALLY PRINTED PRODUCTS, ARRIVING IN AN IMBRICATED STREAM TO A TRANSPORT DEVICE

[75] Inventor: Walter Reist, Hinwil, Switzerland

[73] Assignee: Ferag AG, Hinwil, Switzerland

[21] Appl. No.: 110,822

[22] Filed: Jan. 10, 1980

[30] Foreign Application Priority Data

Jan. 29, 1979 [CH] Switzerland ..... 843/79

[51] Int. Cl.[3] ..... B65H 29/04

[52] U.S. Cl. ..... 198/461; 198/650; 271/202; 271/204; 271/182; 271/183; 271/277

[58] Field of Search ..... 271/271, 182, 183, 277, 271/202, 204–206; 198/650, 461

[56] References Cited

U.S. PATENT DOCUMENTS

| | | | |
|---|---|---|---|
| 3,595,138 | 7/1971 | Brockmuller | 271/183 X |
| 3,596,575 | 8/1971 | Brockmuller | 271/183 X |
| 4,201,286 | 5/1980 | Meier | 271/202 X |

*Primary Examiner*—Richard A. Schacher
*Attorney, Agent, or Firm*—Werner W. Kleeman

[57] ABSTRACT

Attached to revolving traction elements are a number of equidistantly arranged entrainment members having impact surfaces at their leading edges. The impact surfaces engage at trailing edges of the printed products arriving in an imbricated product stream. Between the traction elements there is arranged a suction head connected by means of a connection line or conduit with a negative pressure source. The suction head fixedly retains the printed products moving therepast or delays their forward movement until the engaged printed product can be entrained by one of the entrainment members. Due to the holding back of each second printed product each entrainment member infeeds two superimposed printed products to the individual grippers of a transport device. Since each gripper conveys away two printed products the transport device can be driven at a lower velocity that the infeed velocity of the imbricated product stream, which, among other things, affords quieter travel and reduced wear of the transport device.

9 Claims, 2 Drawing Figures

APPARATUS FOR INFEEDING FLAT PRODUCTS, ESPECIALLY PRINTED PRODUCTS, ARRIVING IN AN IMBRICATED STREAM TO A TRANSPORT DEVICE

CROSS-REFERENCE TO RELATED CASES

This application is related to U.S. application Ser. No. 908,538, filed May 22, 1978 now U.S. Pat. No. 4,201,286, granted May 6, 1980, and U.S. application Ser. No. 06/051,344, filed June 25, 1979, and U.S. Pat. No. 3,955,667, granted May 11, 1976, U.S. Pat. No. 4,072,228, granted Feb. 7, 1978 and U.S. Pat. No. 4,039,182, granted Aug. 2, 1977.

BACKGROUND OF THE INVENTION

The present invention relates to a new and improved construction of apparatus for infeeding essentially flat products, especially printed products, arriving in an imbricated product stream, to a transport device.

Generally speaking, the apparatus of the present invention is of the type wherein the transport device contains, viewed in the direction of conveying, tandemly arranged gripper elements for seizing the infed products. A conveyor element is provided which is equipped with a number of equidistantly spaced entrainment members which engage at the trailing edges of the products. These entrainment members are revolvingly driven at a greater velocity in relation to the infeed velocity of the imbricated product stream.

With an infeed apparatus of this type, as the same is disclosed for instance in German Patent Publication No. 2,822,060 and the aforementioned cognate commonly assigned, U.S. Pat. No. 4,201,286, to which reference may be readily had, there is infed to each gripper of the transport device one printed product. This means that the conveying velocity of the transport device must correspond to the conveying velocity of the infeed apparatus, which, in turn, must be accommodated to the infeed velocity of the imbricated product stream. Now if the imbricated product stream is delivered at a greater velocity or speed, for instance by a rotary printing press, then the correspondingly high travel velocity of the transport device, among other things, produces increased wear of the latter.

SUMMARY OF THE INVENTION

Therefore, with the foregoing in mind it is a primary object of the present invention to provide a new and improved construction of product infeed apparatus of the type mentioned which is not afflicted with the aforementioned drawbacks and limitations of the prior art proposals discussed above.

Another and more specific object of the present invention aims at reducing the travel speed of the transport device, without at the same time having to correspondingly reduce the conveying speed of the infeed apparatus.

Now in order to implement these and still further objects of the invention, which will become more readily apparent as the description proceeds, the apparatus of the present development is manifested by the features that the spacing between the entrainment members is greater than the spacing between the trailing edges of two overlying products and that means are provided which engage at individual products which serve to reduce the conveying velocity of the momentarily influenced product in relation to the conveying velocity of a given number of trailing products until the thus influenced product is engaged by one of the entrainment members.

By holding back or delaying certain of the products, for instance each second product, it is possible to convey with each entrainment member a number of products, for instance two products, in overlying relationship to one another into the transport device. These products which are infed by the same entrainment member are collectively seized and transported away by a gripper element or gripper of the transport device. This enables operating the transport device so as to run less rapidly, while nonetheless transporting away all of the products infed by the infeed apparatus or device. The conveying output of the transport device therefore corresponds, just as was heretofore the case, to the conveying output of the infeed apparatus. The reduction of the travel speed of the transport device affords quieter travel and a reduction in the wear thereof. The processing equipment arranged downstream of the transport device, for instance stackers by way of example, therefore have available, with the same processing output, more time for processing the individual packets of products which have been released by each gripper element.

BRIEF DESCRIPTION OF THE DRAWING

The invention will be better understood and objects other than those set forth above will become apparent when consideration is given to the following detailed description thereof. Such description makes reference to the annexed drawing wherein throughout the various Figures the same reference characters have been used to denote the same or analagous structure and wherein.

DETAILED DESCRIPTION OF THE PREFERRED EMBODIMENTS

Figure 1:
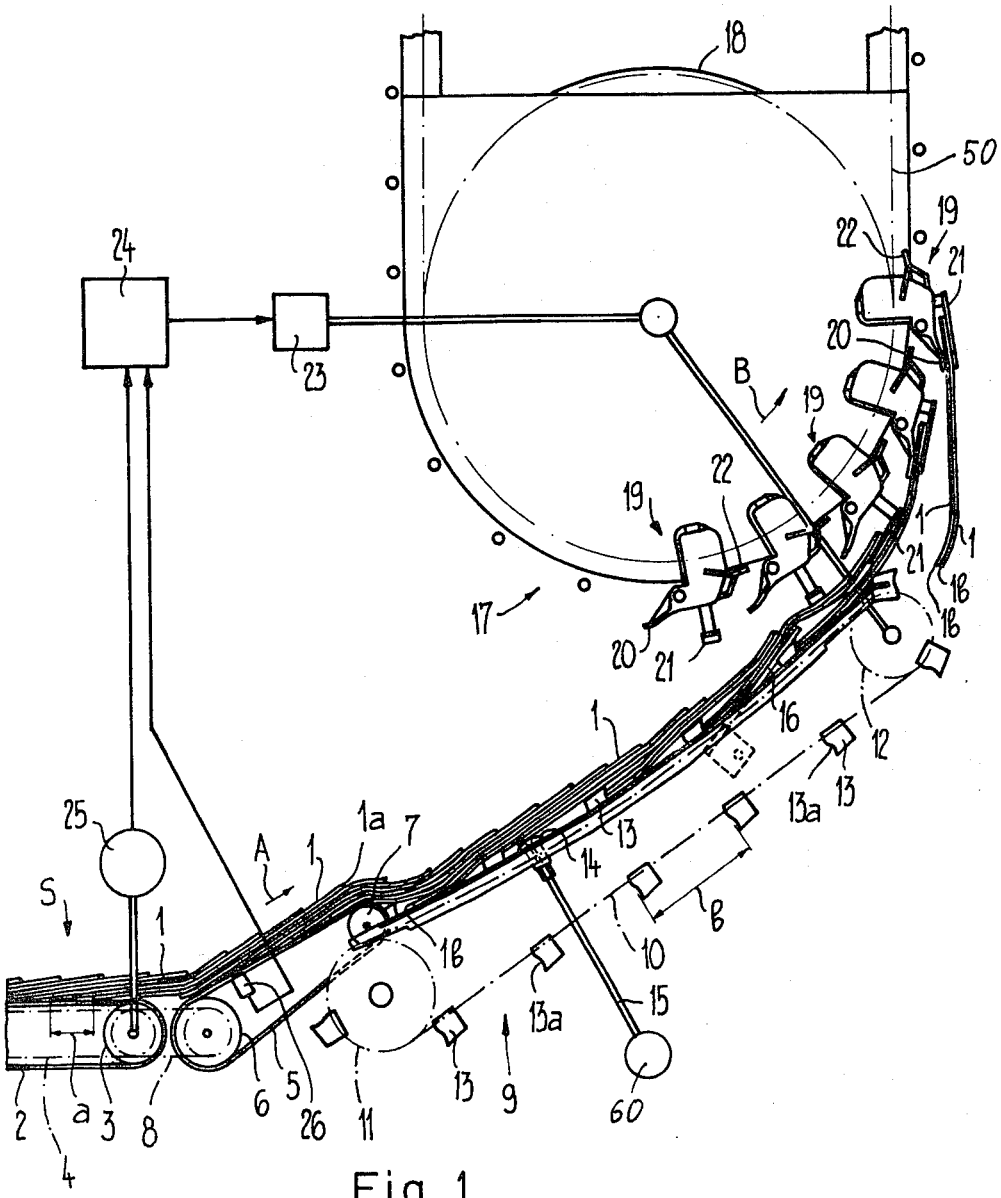
FIG. 1 illustrates in side view an exemplary embodiment of conveyor apparatus for feeding away printed products arriving in an imbricated product stream.

Describing now the drawings and specifically FIG. 1, the products 1, here assumed to be printed products, and arriving in an imbricated product stream S, are infed by means of an only partially shown infeed band or belt 2. The individual printed products 1 are present in an imbricated product stream S in a manner such that they overlie one another much like the tiles of a roof or a fanned deck of cards, so that each printed product 1 comes to bear upon the next leading printed product. The leading edge 1*a* of each printed product 1, which in the embodiment under discussion constitutes the fold edge (so-called spine), therefore is freely exposed, whereas the trailing edge 1*b* of each printed product 1 is covered by the trailing printed product. The infeed belt or band 2 is guided over a deflection roll 3 which is driven by means of a drive chain 4 by a suitable supply generating the imbricated product stream S, for instance by way of example a rotary printing press. The infeed belt or band 2 has arranged thereafter an endless intermediate band or belt 5 which is guided over deflection rolls 6 and 7. The not particularly referenced active conveying run of this intermediate band or belt 5 travels in an ascending direction. The drive of the deflection roll 6 is accomplished by means of a drive chain 8 or equivalent structure through the intermediary of the deflection roll 3. The imbricated product stream S, conveyed by the belts or bands 2 and 5 in the direction of the arrow A, following the intermediate band 5 is received by a conveyor element or device 9. This conveyor element of device 9 has two endless traction or tension elements 10 arranged in spaced relationship from one another, only one of these traction elements 10 being visible in the showing of the drawings, and they are guided over two deflection rolls or rollers 11 and 12. Equidistantly arranged at these traction elements 10 are the entrainment members 13 which are provided at their leading edges with their related impact or abutment surface 13*a* for the entrainment of the printed products 1. The spacing b between the impact surfaces 13*a* of neighboring entrainment members 13 is larger than the spacing a between the trailing edges 1*b* of overlying printed products 1. At the intermediate region between both of the traction elements 10 there is arranged an element acting upon predetermined ones of the printed products, here shown by way of example as a stationary suction head 14 which flow communicates by means of a connection line or conduit 15 continuously with a conventional and therefore merely schematically shown negative pressure source 60. At the end region of the active conveying path of the entrainment members 13 there is arranged a guide ramp 16 affording faultless transfer of the printed products 1 to a transport device 17.

This transport device 17, only part of which has been shown in the the drawings, corresponds in its construction and mode of operation to the transport device disclosed in German Patent Publication No. 2,519,561 and the corresponding U.S. Pat. No. 3,955,667, granted May 11, 1976, to which reference may be had and the disclosure of which is incorporated herein by reference, so that no further discussion thereof is believed to be here necessary. At a suitable traction element, generally symbolized by reference character 50, which is trained about the deflection wheel 18 of the transport device 17, there are arranged grippers or gripper elements 19 behind one another in the conveying direction B. Each gripper or gripper element 19 has an upper stationary clamping jaw 20 and a lower movable clamping jaw 21. In the closed position of the lower clamping jaw 21 the seized printed products 1 are retained between both of the clamping jaws 20 and 21. By means of a locking element 22 the movable clamping jaw 21 is retained in its clamping position. The transport device 17 is driven by a suitable drive motor 23, the drive speed of which is controlled by a drive control 24. This drive control 24 has infed thereto signals received from a rotational speed transmitter 25 which is coupled with the deflection roll 3, and also from a signal transmitter 26 responsive to the moving past trailing edges 1*b* of the printed products 1 and which infeeds signals to the drive control 24. The drive control 24 processes the received signals and influences in conventional manner the drive motor 23 in order to accommodate the travel speed of the transport device 17 to the velocity of the arriving printed product stream S. The conveyor element 9 is driven by the transport device 17, and specifically, at a velocity which is greater in relation to the infeed velocity of the imbricated product stream S.

Having now had the benefit of the foregoing description of the apparatus of this development its mode of operation will be considered and is as follows:

The entrainment members or elements 13 of the conveyor element or device 9 underlie the imbricated product stream S which is infed by the transport belts 2 and 5. These entrainment members 13 engage, by means of their impact surfaces 13*a*, at the trailing edges 1*b* of the printed products 1 and convey the printed products, engaged in this manner, to the transport device 17. Since as already explained the spacing b between neighboring entrainment members 13 is greater than the spacing a between the trailing edges 1*b* of successive printed products 1, each single printed product 1 is not operatively correlated with a given entrainment member 13, rather each two printed products. At the start of the active conveying path of the entrainment members 13 there is therefore not engaged each printed product, rather each second printed product, by an entrainment member 13. As soon as those printed products 1, which do not bear against the impact surface 13*a* of an entrainment member 13 and are loosely entrained in the composite imbricated product stream, arrive at the effective region of the suction head 14, such printed products are fixedly retained, or at the very least delayed in their further movement, by the suction action of such suction head 14, until the next entrainment member 13 impinges against the trailing edge 1*b* of this printed product fixedly retained by the suction head 14 and also entrains such printed product. The retaining force exerted by the suction head 14 upon the printed product is less than the feed or advance force exerted by the entrainment members 13 upon the printed products 1, so that an entrainment of the printed products engaged by the suction head 14 by the entrainment members 13 is possible at any time, even though the suction head 14 is continuously connected with the negative pressure source 60.

Thereafter following the suction head 14 each entrainment member 13 thus conveys two printed products 1 which mutually contact or overlie one another. Both of these overlying printed products are pushed over the guide ramp 16 or equivalent structure into the transfer region of the grippers 19. The grippers 19 which arrive at the transfer region in an open condition then engage, in conventional fashion, both of the overlying printed products 1 at their leading edges 1*a* and convey the thus seized printed products 1 to any suitable processing station, which therefore has not been further shown to simplify the illustration. At such processing station the printed products 1 are deposited and can then either be processed in two's , in the manner that they have been infed, or else pulled apart into a new imbricated product stream.

Since there are conveyed with each gripper or gripper element 19 two product copies, it is possible to drive the transport device 17 at a conveying velocity or speed which is half as great as the conveying velocity of the transport belts or bands 2 and 5 of the conveyor device 9. Nonetheless, the transport device 17 is capable of outfeeding all of the incoming printed products. It is also possible, instead of continuously connecting the suction head 14 with the negative pressure source 60, to connect this suction head periodically with the negative pressure source, in order to release the seized or engaged printed product at that point in time where it is transferred to and engaged by an entrainment member 13. However, this proposal would of course require an appropriate control, which, in relation to the discussed solution would require a greater expenditure in equipment.

Figure 2:
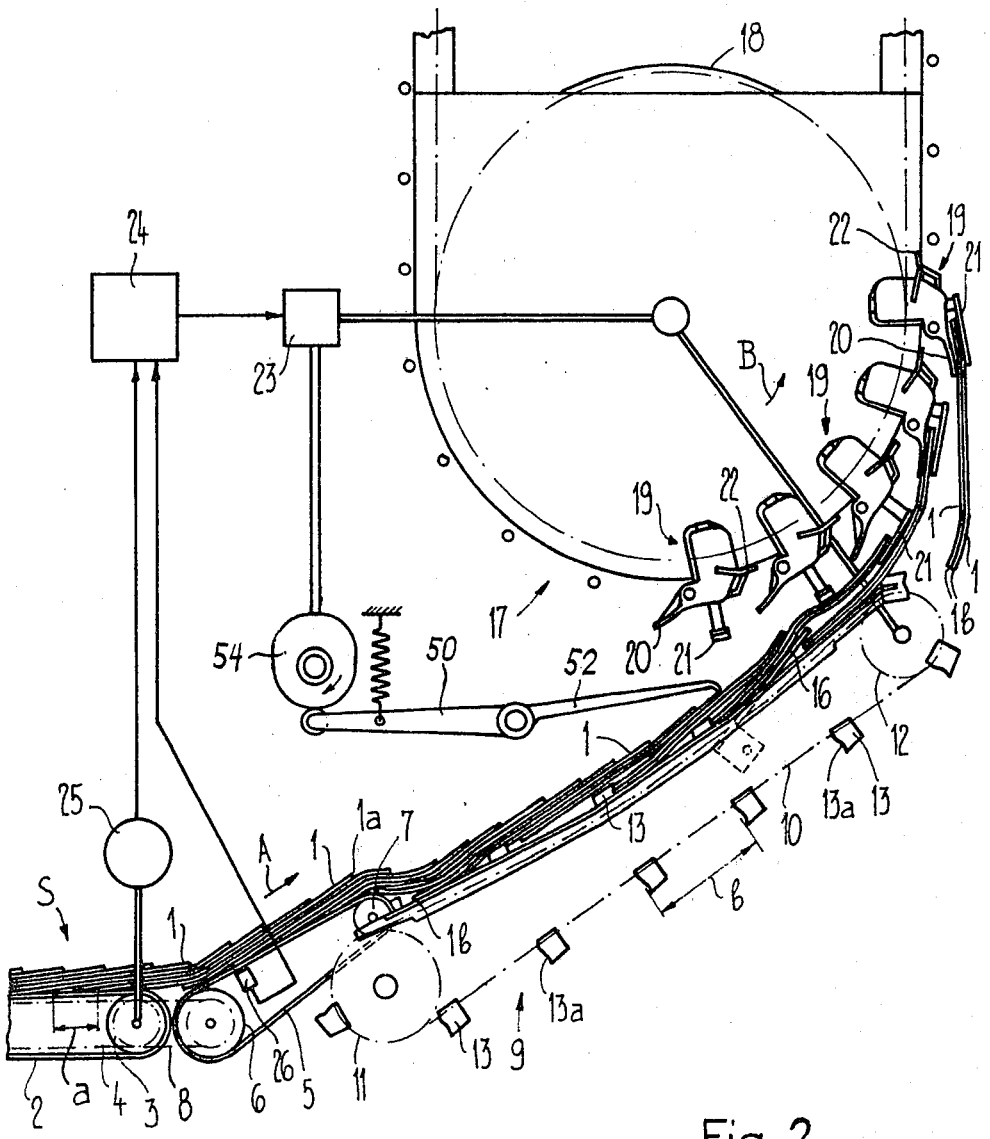
FIG. 2 illustrates, like in the showing of FIG. 1, a modified construction of conveyor apparatus according to the invention.

It is also possible to hold back or retard the printed products 1, instead of by applying a negative pressure, in a mechanical manner for such length of time until they are engaged by an entrainment member 13. For this purpose, and as shown in FIG. 2, there can be provided at the region of the conveyor element or device 9 a retaining or holding element 50 which can be periodically introduced into the imbricated product stream, in order to fixedly retain a given number of printed products 1 until they are conjointly entrained by an entrainment member 13. This retaining or holding element 50 can be for instance constituted by a lever 52 arranged above the printed product stream S, the lever being raised and lowered by a suitable control mechanism 54 and in its position where it has been inserted or introduced into the imbricated product stream S holds back the printed products 1 at their leading edges 1*a*. As soon as the retained printed products are entrained by an entrainment member 13, then the lever 52 must again be raised and the printed products released. This solution has the advantage, in contrast to the embodiment described in conjunction with FIG. 1 of the accompanying drawings, that at the same time there can be fixedly held not only one printed product 1, rather two and more printed products, enabling each gripper 19 of the transport device 17 to have infed thereto more than two printed products.

According to a further development of the infeed apparatus the entrainment members 13 are guided, in the manner as shown in FIGS. 1, along their active conveying path at an ascending path of travel. However, each entrainment member 13 is provided with at least one freely rotatable support roll serving as a support means for the printed products 1. The spacing between the entrainment members 13 is likewise greater than the spacing between the trailing edges 1*b* of overlying printed products 1. The printed products 1 which are engaged at the start of the active conveying path, not by an entrainment member 13, can slide back opposite to the conveying direction by virtue of the freely rotatable support rolls, until they are entrained by the next entrainment member 13. In this way it is possible to delay two and more printed products in their forward movement for such length of time until they are entrained by an entrainment member 13. The last mentioned solution corresponds extensively to the embodiment illustrated in FIG. 7 of Swiss patent application Ser. No. 8747/78, wherein, in contrast to the latter, there is omitted each second, each third and so forth entrainment member.

It is also conceivable, with the apparatus illustrated in FIGS. 1 to 3 of the previously mentioned Swiss patent application Ser. No. 8747/78, to provide a suction head 14 which, in the described manner, holds back or delays in its forward movement, each printed product moving therepast for such length of time until the related entrainment member 13 engages at such printed product. With the aid of this suction head 14 it is possible to ensure in this manner that, under all circumstances, each printed product will be entrained by an entrainment member.

While there are shown and described present preferred embodiments of the invention, it is to be distinctly understood that the invention is not limited thereto, but may be otherwise variously embodied and practised within the scope of the following claims. ACCORDINGLY,

What I claim is:

1. An apparatus for infeeding substantially flat products, especially printed products, arriving in an imbricated products stream, to a transport device, comprising:

a transport device having gripper elements arranged behind one another with respect to a direction of conveying of the products;

said gripper elements serving for engaging the infed products;

a conveyor device provided with a number of substantially equidistantly spaced entrainment members for engaging trailing edges of the products;

means for revolvingly driving said conveyor device at a greater velocity in relation to the infeed velocity of the imbricated stream of products;

the spacing between each two neighboring entrainment members being greater than the spacing between the trailing edges of two printed products which bear upon one another;

means for engaging individual ones of said products in the product stream conveyed by said conveyor device; and said engaging means reducing the speed of conveying of the momentarily engaged product in relation to the conveying speed of a given number of trailing products until engagement by one of the entrainment members.

2. The apparatus as defined in claim 1, wherein:

said engaging means comprises holder means adapted to be connected to a negative pressure source and capable of acting upon at least certain of the products;

said holder means being arranged at the region of the conveying device; and said holder means affecting the forward movement of the printed products engaged under the action of the suction force until entrainment thereof by one of the entrainment members.

3. The apparatus as defined in claim 2, wherein:

said holder means fixedly retain the printed products until engagement by the entrainment member.

4. The apparatus as defined in claim 2, wherein:

said holder means delays the forward movement of the engaged printed product until entrainment by the entrainment member.

5. The apparatus as defined in claim 2, wherein:

said holder means is continuously connected with the negative pressure source; and the holding force of the holder means is less than the feed force exerted by the entrainment members upon the printed products.

6. The apparatus as defined in claim 1, wherein:

said engaging means comprises a retention element arranged at the region of the conveying device and periodically insertable into the imbricated product stream; and said retention element fixedly holding a given number of products until their conjoint entrainment by one of the entrainment members.

7. The apparatus as defined in claim 6, wherein:

said retention element comprises a lever arranged above the imbricated product stream;

a control mechanism with which there is operatively coupled said lever; and said lever being movable into a position where it can engage with the leading edges of the printed products.

8. The apparatus as defined in claim 1, wherein:

the entrainment members are guided along their conveying path at an ascending path of travel and are equipped with at least one freely rotatable support roll serving as support means for the products.

9. The apparatus as defined in claim 2, wherein:

the holding means is arranged below the imbricated product stream.

* * * * *